United States Patent [19]

Delannoy et al.

[11] Patent Number: 4,502,981

[45] Date of Patent: Mar. 5, 1985

[54] ENHANCING CONDUCTIVITY OF DONOR-DOPED POLYACETYLENE

[75] Inventors: Philippe G. Delannoy, Randolph; Granville G. Miller, Morristown; Helmut Eckhardt, Madison; Ray H. Baughman, Morris Plains, all of N.J.

[73] Assignee: Allied Corporation, Morris Township, Morris County, N.J.

[21] Appl. No.: 475,996

[22] Filed: Mar. 16, 1983

[51] Int. Cl.[3] ..... H01B 1/06

[52] U.S. Cl. ..... 252/512; 252/518; 528/481; 528/488; 528/503; 204/2.1

[58] Field of Search ..... 252/500, 512, 518; 528/488, 481, 503; 204/2.1, 291, 131, 165; 524/439

[56] References Cited

U.S. PATENT DOCUMENTS

| | | | |
|---|---|---|---|
| 4,200,716 | 4/1980 | Pez | 526/141 |
| 4,204,216 | 5/1980 | Heeger et al. | 357/8 |
| 4,222,903 | 9/1980 | Heeger et al. | 252/518 |
| 4,321,114 | 4/1980 | Pez | 204/2.1 |
| 4,411,826 | 10/1983 | Naarman et al. | 252/512 |

OTHER PUBLICATIONS

A. Pron et al., *Mat. Sci. VII*, pp. 305–312, (1981).

M. Rolland et al., *J. Electronic Materials*, vol. 10, pp. 619–630, (1981).

A. M. Rolland et al., *Polymer*, (Polymer Communications), vol. 21, pp. 1111–1112, (1980).

G. Wegner, "Polymers with Metal-like Conductivity–A Review of their Synthesis, Structure & Properties", *Agnew Chem. Int. Ed. Engl.*, vol. 20, pp. 361–381, (1981).

T. Ito et al., *J. Polymer Sci.*, Polymer Chem. Ed., vol. 12, pp. 11–20, (1979).

L. B. Luttinger, *J. Org. Chem.*, 27, 1591–96, (1962).

M. Aldissi et al., *Polymer*, vol. 23, pp. 243–245, (1982).

*Primary Examiner*—Josephine L. Barr

*Attorney, Agent, or Firm*—Alan M. Doernberg; Richard C. Stewart, II

[57] ABSTRACT

Polyacetylene doped with potassium or rubidium cations (and optionally with other alkali metal cations) is heat treated at 60°–400° C., preferably 100°–250 ° C., to achieve greatly enhanced room temperature conductivity. Products with relative conductivities 150%, 300%, 450% or more of the conductivity prior to heat treating are obtained, with room-temperature conductivities of 300 S/cm, 450 S/cm, or higher.

18 Claims, No Drawings

ENHANCING CONDUCTIVITY OF DONOR-DOPED POLYACETYLENE

DESCRIPTION

The present invention relates to a process for enhancing the conductivity of donor-doped polyacetylene, and to polyacetylene materials and articles produced by such process.

It is well known that polyacetylene, in film and other forms, can be doped either with acceptor-doping agents (such as arsenic pentafluoride) or donor doping agents (such as alkali metals). It is also known that polyacetylene, as formed by polymerization, is usually in the cis form predominately, whereas various treatments are capable of converting it to the more stable, but brittle trans form. Stability studies at various temperatures have been conducted for acceptor-doped polyacetylene. Thus, for example, A. Pron et al., in Materials Science VII, pp. 305–312 (1981) demonstrate that the conductivity of iodine-doped polyacetylene decays to half its original value after 10 minutes at 80° C. or after less than 1 minute at 140° C. At 145° C. the removal of iodine is almost complete and the conductivity decay by seven orders of magnitude in 1 hour is irreversible. Other references similarly report the decay of conductivity of arsenic pentafluoride-doped polyacetylene (especially above 50° C.) and antimony pentafluoride-doped polyacetylene (decays to half its value in 20 hours at 80° C. or 2 hours at 140° C., M. Rolland et al., J. Electronic Materials, Vol. 10, pp. 619–630 (1981)). Thus, it is indicated that acceptor-doped polyacetylene decreases in conductivity upon heat treatment.

Heat treatment has also been performed on undoped-polyacetylene. It is indicated by M. Rolland et al., in *Polymer* (Polymer Communications), Vol. 21, pp. 1111–1112 (1980) that the conductivity rises from $10^{-9}$ S/cm to $10^{-5}$ S/cm by heat treatment. It is explained, however, that such conductivity rise is a result of isomerization from the less conductive cis configuration to the more stable trans configuration. It should be appreciated, however, that even a conductivity of $10^{-5}$ is far less than that achievable by either acceptor or donor doping of polyacetylene. See, for example, U.S. Pat. Nos. 4,222,903 and 4,204,216 of Heeger et al.

Donor-doped polyacetylene has been studied by a variety of workers in terms of the morphology, electronic structure and crystalline structure achieved. Such studies have dealt primarily with lithium-doped and sodium-doped polyacetylene, but some work on higher alkali metals has also been performed. It is not believed that, in any case, heat treatment was applied to alkali metal-doped polyacetylenes, and especially not with the higher alkali metals.

BRIEF DESCRIPTION OF THE INVENTION

It has been discovered that heat treatment causes a remarkable increase in the room temperature conductivity of potassium-doped or rubidium-doped polyacetylene. It has been further discovered that the decrease of electrical conductivity with decreasing temperature below room temperature is reduced by this heat treatment. These advantageous results do not appear to occur when using polyacetylene doped solely by lithium or sodium, but are applicable to polyacetylene doped by potassium or rubidium and additionally doped by another alkali metal. Accordingly, the present invention includes a process for the preparation of donor-doped polyacetylene of increased conductivity which comprises heating and maintaining a potassium-doped or rubidium-doped polyacetylene at at least one elevated temperature between about 60° C. and about 400° C. and cooling back to a temperature below about 50° C., with the time at elevated temperature being sufficiently long to increase the conductivity of the potassium-doped or rubidium-doped polyacetylene (measured by the four probe method at room temperature) to at least 150 percent of its conductivity prior to heating to elevated temperature. The present invention also includes donor-doped polyacetylene materials and articles produced by the above process.

DETAILED DESCRIPTION OF THE INVENTION

The process of the invention is applicable to polyacetylene doped with selected alkali metals by a variety of techniques. Accordingly, the polyacetylene used may be films or other articles formed by a variety of polymerization technologies, including those described in U.S. Pat. Nos. 4,200,716 of Pez et al. and 4,222,903 and 4,209,216 of Heeger et al. (commonly referred to as the Shirakawa technique).

Representative preparation techniques for polyacetylene are described in the following: G. Wegner, "Polymers With Metal-Like Conductivity - A Review of their Synthesis, Structure and Properties" *Agnew. Chem. Int. Ed. Engl.*, vol. 20, pp 361–81 (1981); T. Ito et al., *J. Polymer Sci., Polymer Chem. Ed.*, vol. 12, p. 11–20 (1979); L. B. Luttinger, J. Org. Chem. 27, ( 1591–96 (1962) M. Aldissi et al., *Polymer*, vol. 23, pp 243–45 (1982).

On polymerization, the polyacetylene may be in the form of a film, gel, powder or other structure which, in some cases, may be further modified or treated (e.g. by compression) to form a desired shape. The polyacetylene produced by the Shirakawa technique, for example, is normally a microfibular structure conveniently in film or sheet form.

The doping of the polyacetylene may be done chemically, electrochemically or by ion implantation. Thus, for example, alkali metal compounds such as potassium naphthalide, benzophenone or biphenyl may be dissolved in an inert solvent and used to contact the polyacetylene. Such treatments are described in several of the above references and are well known to the art. Furthermore, the polyacetylene may be doped by the alkali metal cation electrochemically, as described, for example, in U.S. Pat. No. 4,321,114 to MacDiarmid et al. (1982). In such methods, for example, the polyacetylene is placed in contact with a solution of an alkali metal salt (e.g. potassium perchlorate) and used as the anode of an electrochemical cell. After operation of such a process, the polyacetylene becomes doped with alkali metal cations (e.g. potassium cations) from the solution.

The polyacetylene may even be doped and thermally treated in one step by heating the polyacetylene and an alkali metal or alkali metal alloy in an evacuated tube. In this case doping occurs via a direct reaction between the polyacetylene and the molten metal or metal vapor.

The polyacetylene produced by low temperature synthesis may be in predominantly the cis-configuration. However, either thermal annealing or the doping process appear capable in many instances of increasing the proportion of trans-polyacetylene to cis-polyacetylene.

In the process of the present invention, such doped polyacetylene is heated to and maintained at an elevated temperature between about 60° C. and about 400° C. and then cooled back to a temperature below about 50° C. such as room temperature. There is an interconvertability between the time and temperature in the sense that longer anneal times at lower temperatures are equivalent to shorter anneal times at higher temperatures. While anneal temperatures much above 230° C. can be employed, the use of such high anneal temperatures requires the use of rapid heating and cooling methods since long residence times at such temperatures can result in degradation. The doped polyacetylene should normally be maintained either in an inert atmosphere, an atmosphere containing the vapor of the alkali metal, or surrounded by an inert solvent during the heat treatment to avoid degradation. Thus, for example, the doped polyacetylene may be held in a noble gas atmosphere, in nitrogen or in other nonreactive gases, in a hydrocarbon solvent, or in another inert solvent such as tetrahydrofuran or 3-methyl tetrahydrofuran or dimethylformamide. The time and temperatures for the heat treatment will together be varied to achieve the desired degree of enhanced conductivity. Thus, for example, using potassium-doped polyacetylene, treatment in an oil bath can be conducted at a temperature such as 180° C. for a time such as 30 minutes to achieve the dramatic (over fourfold) increase in conductivity indicated in Example 1. Other combinations of time and temperature are indicated in the Examples. In general, temperatures above about 230° C. should either be avoided or kept reasonably short (under 5 minutes) to avoid polymer degradation. Furthermore, temperatures between about 100° C. and about 250° C. are preferred. Over all heat treatment times are preferably between about 30 minutes and about 0.5 minutes because such conditions represent feasible processing times in commercial operation; however, shorter or longer times may be used without detrimental effect provided that either the temperature employed is modified or lower or higher degrees of enhanced conductivity are acceptable. Furthermore, the exact effect of any particular combination of time and temperature on any particular alkali metal-doped polyacetylene will vary, and can be determined by routine experimentation by one skilled in the art familiar with the present Examples. It is specifically contemplated that the heat treatment may be staged over a variety of temperatures or may be conducted over a temperature gradient, such as for example that achieved by gradually heating the donor-doped polyacetylene to a specific peak temperature and, immediately or shortly thereafter, slowly cooling the sample to room temperature.

As indicated by some of the comparative examples below, the effects achieved by the present invention are not achieved when the polyacetylene is doped solely by lithium or sodium. Such desired effects are to increase the room temperature conductivity to at least 150 percent of its conductivity prior to heating, preferably to at least 300 percent of its conductivity prior to heating and more preferably at least 450 percent of its conductivity prior to heating. Furthermore, because potassium is cheaper and more readily available than rubidium, the invention is preferably applied to a potassium-doped polyacetylene and especially to a polyacetylene represented by the empirical formula $[CHK_n]$ wherein n is a number between about 0.04 and about 0.25, more preferably between about 0.15 and about 0.20. Such polyacetylene may be prepared by electrochemical doping, by doping polyacetylene with a potassium arylate such as potassium naphthalide, or by doping with a potassium-alkali metal eutectic mixture. Other preferred forms of the invention are those wherein the donor-doped polyacetylene is doped both with potassium cations and at least one additional alkali metal cation (and especially potassium cations plus sodium cations or potassium cations plus lithium cations). Desirable room temperature conductivities achieved by the present process (and inherent in the present products) are a room temperature conductivity of at least about 300 S/cm, more preferably at least about 450 S/cm and most preferably at least about 700 S/cm. The most preferred values, both for flexible films and other articles, have hitherto not been achieved with donor-doped polyacetylene, but only have been achieved with acceptor-doped polyacetylene.

By shaping the articles prior to doping or prior to heat treatment, a variety of polyacetylene articles can be produced by the present process. Thus, for example, polyacetylene films used in batteries, solar cells, and electronic amplification and rectification devices can be produced. A preferred battery employing the polyacetylene articles of the present invention as an electrode is described in a copending application of Lawrence W. Shacklette, entitled "Secondary Battery Containing Organoborate Electrolyte" Ser. No. 475,995 filed Mar. 16, 1983 now abandoned commonly assigned and filed herewith). Such a battery is illustrated by Example 19 below. Other articles wherein the donor-doped polyacetylene of enhanced conductivity produced by the present process may be used include solar cells, and electronic amplification and rectification devices.

EXAMPLE 1

A film of cis-rich polyacetylene, prepared by the Shirakawa methods, washed with THF, 2.6 mil thick, was doped with potassium naphthalide in THF for 16 hours at room temperature, washed and dried for 2.5 hours by vacuum pumping. The composition after doping was $[CHK_{0.19}]_x$ measured by weight uptake. The film was flexible, silver gold in color and had an electrical conductivity of 92 $\Omega^{-1}cm^{-1}$ measured by the linear four probes method. After heating under dynamic vacuum in an oil bath at 180° C. for 30 minutes and cooling to room temperature the conductivity was 470 $\Omega^{-1}cm^{-}$. This is a permanent increase by a factor of more than 5 and the one of the highest conductivities reported for donor doped polyacetylene. No significant decrease of this high conductivity was observed after storage at room temperature under argon in a dry box. The film was still completely flexible.

A similar treatment of any acceptor-doped polyacetylene (with $AsF_5$, $SbF_5$ or $I_2$) for example would result in an irreversible decrease of conductivity of several orders of magnitude.

EXAMPLE 2

A film of cis-rich polyacetylene doped in the manner of Example 1 for 90 minutes with a composition $[CHK_{0.16}]_x$ had a conductivity of 58 $\Omega^{-1}cm^{-1}$. After heating under a reduced pressure of argon at 200° C. for only 9 minutes in a oil bath and cooling to room temperature, the conductivity was 270 $\Omega^{-1}cm^{-1}$, a permanent increase by a factor of 4.6 without loss of flexibility. No significant decrease of this conductivity was observed after 12 days of storage at room temperature under argon in a dry box. Further heating at 200° C. for 20 hours did not change the conductivity nor the flexibility. We have therefore produced a highly conductive, highly heat-stable polymeric material without loss of mechanical properties. An additional 16 hours at 220° C. decreased the conductivity by a factor of ~2 to 130 $\Omega^{-1}cm^{-1}$ and an additional 4 hours at 260° C.-280° C. reduced the conductivity by a factor of ~10 to 30 $\Omega^{-1}cm^{-1}$. The film was then very brittle and crumbled upon handling.

EXAMPLE 3

A film of undoped polyacetylene was heated to 140° C. for 20 minutes in an evacuated sealed glass tube to produce cis-trans isomerization. After doping this film in the manner of Example 1 for 16 hours, a slightly brittle gold film with composition $[CHK_{0.18}]_x$ and a conductivity of 100 $\Omega^{-1}cm^{-1}$ was obtained. After heating at 140° C. for 16 hours in a sealed tube under vacuum and cooling to room temperature, the conductivity ranged between 650 $\Omega^{-1}cm^{-1}$ and 1300 $\Omega^{-1}$ $^{-1}$ depending on the region of the film, showing a permanent increase between 6.5 and 13. The film showed increased brittleness. The next day the conductivity was not higher than 290 $\Omega^{-1}cm^{-1}$, perhaps because of a slightly contaminated dry box.

EXAMPLE 4

A film of cis-rich polyacetylene was doped in the manner of Example 1 for 16 hours to a composition $[CHK_{0.17}]_x$ and a conductivity of 42 $\Omega^{-1}cm^{-1}$. After heating at 100° C. for 16 hours in a preflamed tube, evacuated thoroughly and sealed, the room temperature conductivity was 260 $\Omega^{-1}cm^{-1}$, a permanent increase by a factor of 6.2. Further heating at 140° C. for 16 hours resulted in a room temperature conductivity of 410 $\Omega^{-1}cm^{-1}$, an overall permanent increase of 9.8 with no loss of flexibility. Much longer times are therefore necessary at lower temperatures.

EXAMPLE 5

A film of cis-rich polyacetylene was doped in the manner of Example 1 for 16 hours to obtain a composition of $[CHK_{0.17}]_x$ and a conductivity of 54 $\Omega^{-1}cm^{-1}$. After one month storage under argon in the dry box at room temperature (wherein reaction with contaminants in the argon is possible) the conductivity had decreased to 25 $\Omega^{-1}cm^{-1}$. Heating in an evacuated sealed tube for 90 minutes at 100° C. resulted in a room temperature conductivity of 54 $\Omega^{-1}cm^{-1}$, further heating at 100° C. for 90 minutes gave 110 $\Omega^{-1}cm^{-1}$ and 90 more minutes at 140° C. gave 240 $\Omega^{-1}cm^{-1}$. The overall permanent increase in conductivity was 4.4 from the original conductivity and 9.6 from the degraded value with no loss of flexibility. A new heating run at 190° for 90 minutes produced no further increase in conductivity.

EXAMPLE 6

A film of cis-rich polyacetylene, 2 mil thick, was doped with lithium naphthalide in THF for 24 hours at room temperature, washed and dried for 2 hours by pumping. The composition was $[CHLi_{0.46})_x$ by weight uptake. The film was flexible, gold and had an electrical conductivity of 120 $\Omega^{-1}cm^{-1}$. The conductivity remained unchanged by heating at 115° C. for 16 hours.

EXAMPLE 7

Same doping as Example 6 with a conductivity of 77 $^{-1}cm^{-1}$. The conductivity decreased by about 2.7 to 29 $\Omega^{-1}cm^{-1}$ by heating at 180°-200° C. for 16 hours.

EXAMPLE 8

A film of polyacetylene was doped in the manner of Example 1 with sodium naphthalide to a composition $[CHK_{0.18}]_x$ and a conductivity of 16 $\Omega^{-1}cm^{-1}$. The conductivity remained unchanged by heating at 200° C. for 15 minutes. The sample was cooled and very brittle and broke by handling.

EXAMPLE 9

A film of polyacetylene was doped in the manner of Example 1 with rubidium naphthalide for 112 hours to a composition $[CHRb_{0.19}]_x$ and a conductivity of 48 $\Omega^{-1}cm^{-1}$. The film was gold in color and flexible. After heating in a sealed glass tube with partial argon pressure for 16 hours at 140° C., the conductivity had increased by a factor of 1.9 to 92 $\Omega^{-1}cm^{-1}$.

EXAMPLE 10

A film of polyacetylene was doped in the manner of Example 1 with cesium naphthalide for 48 hours to a composition $(CHCs_{0.14})_x$ and a conductivity of 30 $\Omega^{-1}cm^{-1}$. After heating at 60° C. for 16 hours under dynamic vacuum the conductivity had dropped to 23 $\Omega^{-1}cm^{31\ 1}$.

EXAMPLE 11

Same as Example 10, but the conductivity dropped by a factor of 2 by heating at 140° C. for 15 minutes.

EXAMPLE 12

A film of polyacetylene was doped in the manner of Example 1 with equimolar portion of potassium naphthalide and lithium naphthalide for 16 hours to a conductivity of 60 $\Omega^{-1}cm^{-1}$. After heating at 200° C. for 20 minutes under vacuum, the conductivity had doubled to 120 $\Omega^{-1}cm^{-1}$.

EXAMPLE 13

A film of polyacetylene was lightly doped in the manner of Example 1 with potassium naphthalide for 5 minutes to a composition of $[CHK_{0.04}]_x$ and a conductivity of 15 $\Omega^{-1}cm^{-1}$. Heating at 140° C. for 16 hours increased the conductivity by only 50% to 23 $\Omega^{-1}cm^{-1}$.

EXAMPLE 14

A pressed pellet of polyparaphenylene was doped in the manner of Example 1 with potassium naphthalide for 16 hours to a conductivity of 34 $\Omega^{-1}cm^{-1}$. Heating at 200° C. for one hour in a sealed tube with partial argon pressure reduced the conductivity by 40% to 21 $\Omega^{-1}cm^{-1}$.

EXAMPLE 15

The preceding examles deal with the increase of the bulk electrical conductivity by thermal annealing calculated from the bulk resistance, measured by the colinear four probes method. A more practical parameter for any application is the ordinary two probes resistance $R_2$defined as the ratio of the applied voltage to the current, which includes the contact resistance at the interface between the connecting wires and the conducting polymer. These contact resistances may be orders or magnitude higher than the bulk resistance, and therefore, control the actual useful resistance. Typically, for a strip of K-doped polyacetylene of conductivity $\sigma=54$ S/cm about 2 mil thick and 4 mm wide, taken from the same doped film used in Example 2, the total resistance between two mechanically pressed nickel wires separated by 10 mm was $R_2=250$ ohms while the bulk resistance, determined by the four probes measurement was only $R_4=10$ ohms. This example is concerned with a dramatic decrease of the contact resistance by thermal annealing, in addition to the decrease of the bulk resistivity.

One hour at 120° C. increased the bulk conductivity by a factor of 3.2 to 170 S/cm and decreased the two probes resistance to 18 Ω, by a factor of 14. Another hour at the same temperature did not improve the bulk conductivity but $R_2$ decreased to 15 ohms. Finally, 16 additional hours at the same temperature increased the conductivity to 230 S/cm (×4.2) and decreased $R_2$ to 10 ohms, an overall decrease of a factor 25. The corresponding bulk resistance being now 2.3 ohms, the contribution of each contact to the total resistance is about 4 ohms.

This contact resistance is now purely ohmic, being independent of the magnitude of the current at least up to 100 mA, in contrast to the very nonlinear behavior of the contact resistance of the non-annealed sample.

It is well known that electrical contacts on acceptor-doped polyacetylene can be made ohmic by addition of electrodag or silver or gold paste. In this example, no external agent is needed and the thermal treatment only makes the contacts ohmic with the mechanically pressed wires. This is of great importance due to the extreme sensitivity of donor-doped polyacetylene to contamination. It avoids any compensation of the dopant and allows the characterization of the interface between metal and doped polymer. Good ohmic contacts are essential to the fabrication of junction devices.

EXAMPLE 16

This example shows that the thermal treatment produces a conducting polymer more metallic in the sense that the reversible decrease of conductivity by cooling the sample to low temperature is greatly reduced. (For a real metal the conductivity increases reversibly by cooling due to the reduced thermal scattering of carriers).

The film used in Example 15, mounted in a Pyrex® tube filled with argon, was cooled by dipping the tube in liquid nitrogen. The ratio between the conductivity in S/cm at room temperature and at −190° C. before the thermal treatment was $$\frac{\sigma(RT)}{\sigma(-190^\circ\ \text{C.})} = \frac{54}{16} = 3.4,$$

a decrease of 70%, and after 18 hours at 120° C.

$$\frac{\sigma(RT)}{\sigma(-190^\circ\ \text{C.})} = \frac{230}{150} = 1.5$$

a very small residual decrease of 35% of the conductivity, indicative of nearly metallic behavior. In both cases the conductivity returns to the same room temperature value after the cooling cycle.

EXAMPLE 17

A piece of polyacetylene film weighing 3.3 mg was placed into a glass tube about 3 inches (7.8 cm) from a small piece of potassium metal. After evacuation and heat sealing, the tube was immersed in an oil bath for 16 hours at 115° C. The polyacetylene turned from silver to gold and had gained 1 mg in weight. The film remained flexible and exhibited a somewhat non-uniform four probe conductivity of 50 to 100 $(\Omega\text{cm})^{-1}$.

EXAMPLE 18

A small piece of micro-lambda pipette filled with a column of once-molten potassium was placed at the bottom of a 2 mm quartz X-Ray capillary tube. Polyacetylene film was wedged in the tube just above the pipette. The tube was heat sealed.

X-Ray diffraction patterns were taken while the capillary was at room temperature and then after the capillary had been heated to various elevated temperatures. The pattern characteristic to polyacetylene itself shows at room temperature and also after treatment at 100° C. and 160° C. for 16 hours. After heating at 200° C. for 16 hours, an X-Ray diffraction pattern characteristic of polyacetylene treated with potassium naphthalide appears. This pattern remains intact even at the elevated 200° C. temperature.

EXAMPLE 19

Two pieces of cis-rich polyacetylene (4.5 mg each) film to be used as electrodes were enclosed in a metal grid. These were doped with K from potassium naphthalide. A third control piece of PA doped along with the two electrodes analyzed by weight uptake for a composition, $(CHK_{0.24})_x$, and had an initial conductivity of 35 S/cm. One of the electrodes and the control were then heated at 180° C. for 30 minutes under vacuum. A conductivity measurement on the control then showed an increase to 150 S/cm. Two batteries were assembled using the heat treated electrode (HTPA) for one and the untreated electrode (UTPA) for the other. Both batteries contained a sodium counter electrode and an electrolyte of $NaB(C_6H_5)_4$ in THF. Upon assembly both cells had similar internal resistance (26 Ω for the heat treated and 18 Ω for the untreated). The initial open-circuit voltage (OCV) of each cell (both of which may be considered to have been prepared in a heavily discharged state) was 240 mV for HTPA and 77 mV for UTPA. Charging both cells to 2.2V removed an amount of K equivalent to 7.6% for the HTPA and 15.6% for the UTPA. The discrepancy in OCV and in apparent doping level both suggest that some dopant was lost during the extra handling needed for heat treatment. Upon subsequent discharge to 0.1V (i.e., redoping with a mixture of K+Na) the cells displayed a capacity of 7.6% for HTPA and 11.6% for UTPA. Both cells displayed reversible electrochemical doping. Their similar internal resistance arises from the fact that for the cell configuration used, the internal resistance is predominantly limited by electrolyte conductivity. One expects an advantage for the more conductive heat treated PA electrode in a cell configuration where the PA is called upon to act as its own current collector.

We claim:

1. A process for the preparation of donor-doped polyacetylene of increased conductivity which comprises heating and maintaining a potassium-doped or rubidium-doped polyacetylene at at least one elevated temperature between about 60° C. and about 400° C. and cooling back to a temperature below about 50° C., with the time at elevated temperature being sufficiently long to increase the conductivity of the potassium-doped or rubidium-doped polyacetylene (measured by the four-probe method at room temperature) to at least 150% of its conductivity prior to heating to elevated temperature.

2. The process of claim 1 wherein the time at elevated temperature is sufficient to increase said conductivity to at least 300% of said conductivity prior to heating to elevated temperature.

3. The process of claim 2 wherein the time at elevated temperature is sufficient to increase said conductivity to at least 450% of said conductivity prior to heating to elevated temperature.

4. The process of claim 1 wherein said potassium-doped polyacetylene is of an empirical formula $[CHK_n]$wherein n is a number between about 0.04 and about 0.25.

5. The process of claim 4 wherein n is between about 0.15 and about 0.20.

6. The process of claim 1 wherein the potassium-doped polyacetylene is prepared by doping polyacetylene with a potassium arylate.

7. The process of claim 6 wherein said potassium arylate is potassium naphthalide.

8. The process of claim 1 wherein the potassium-doped polyacetylene is prepared by electrochemically doping polyacetylene with a potassium salt.

9. The process of claim 1 wherein said potassium-doped polyacetylene had been predominantly in the cis configuration before doping.

10. The process of claim 1 wherein said potassium-doped polyacetylene is doped with potassium cations and at least one additional alkali metal cation.

11. A donor-doped polyacetylene of increased conductivity prepared by the process of claim 10.

12. A donor-doped polyacetylene of increased conductivity prepared by the process of claim 9.

13. A donor-doped polyacetylene of increased conductivity prepared by the process of claim 4.

14. A donor-doped polyacetylene of increased conductivity prepared by the process of claim 2.

15. A donor-doped polyacetylene of increased conductivity prepared by the process of claim 1.

16. The donor-doped polyacetylene of claim 15 having a room temperature conductivity of at least about 450 S/cm.

17. The donor-doped polyacetylene of claim 15 having a room temperature conductivity of at least about 450 S/cm.

18. The donor-doped polyacetylene of claim 12 being a flexible film of room temperature conductivity of at least about 300 S/cm.

* * * * *